US011617912B1

(12) United States Patent
Fleischman et al.

(10) Patent No.: US 11,617,912 B1
(45) Date of Patent: Apr. 4, 2023

(54) ADJUSTABLE HAND WEIGHT TRAINING APPARATUS

(71) Applicant: Setsmart LLC, Brooklyn, NY (US)

(72) Inventors: Mindy Fleischman, Brooklyn, NY (US); Samuel Stern, Brooklyn, NY (US)

(73) Assignee: Setsmart LLC, Brooklyn, NY (US)

( * ) Notice: Subject to any disclaimer, the term of this patent is extended or adjusted under 35 U.S.C. 154(b) by 0 days.

(21) Appl. No.: 17/943,685

(22) Filed: Sep. 13, 2022

(51) Int. Cl.

| | |
|---|---|
| ***A63B 21/06*** | (2006.01) |
| ***A63B 23/16*** | (2006.01) |
| ***A63B 21/00*** | (2006.01) |
| ***A63B 21/065*** | (2006.01) |

(52) U.S. Cl.
CPC ..... *A63B 21/0603* (2013.01); *A63B 21/065* (2013.01); *A63B 21/4035* (2015.10); *A63B 23/16* (2013.01)

(58) Field of Classification Search
None
See application file for complete search history.

(56) References Cited

U.S. PATENT DOCUMENTS 5,135,455 A * 8/1992 King ..... A63B 21/0726 482/108
5,327,918 A * 7/1994 Stewart ..... A45D 29/22 128/880
5,393,285 A * 2/1995 Fischer, Sr. ..... A63B 21/0602 482/106

OTHER PUBLICATIONS

"Detachable Hand Weight Set, Sportneer Walking Weights of 2 (1lbs, 2lbs Each) Soft Dumbbell Weight Sets for Women Men with Hand Strap Walking Dumbbell for Jogging Running Physical Therapy Aerobics", retrieved from https://www.amazon.com/Sportneer-Walking-Dumbbell-Physical-Aerobics/dp/B097PQCB1N, retrieved on Sep. 7, 2022, 7 pages.
"Gaiam Hand Weights for Women & Men Soft Dumbbell Walking Hand Weight Sets with Hand Strap—Walking, Running, Physical Therapy, Aerobics (Available in 2lb and 4lb Sets)", retrieved from https://www.amazon.com/Gaiam-Neights-Dumbbell-Walking-Weight/dp/B01ICBQLPG, retrieved on Sep. 7, 2022, 9 pages.
"RBX Soft Hand Weights For Walking, Running, Physical Therapy, and Aerobics—with Hand Strap for Ergonomic Grip Bet of 2), Small Weights for Women & Men", retrieved from https://www.amazon.com/RBX-Walking-Weights-Hand-Strap/dp/B095FX5SCX, retrieved on Sep. 7, 2022, 8 pages.

* cited by examiner

*Primary Examiner* — Joshua Lee
(74) *Attorney, Agent, or Firm* — Bochner IP, PLLC; Andrew D. Bochner

(57) ABSTRACT

A training device may include an outer layer; a first end and a second end located at opposing ends of the training device; an adjustable handle including a first piece, a second piece, and a fastener loop; and a contents disposed within a void defined by the outer layer and first and second ends. Each end may include a cuff. The fastener loop may be configured to accept the first piece and the second piece.

14 Claims, 3 Drawing Sheets

ADJUSTABLE HAND WEIGHT TRAINING APPARATUS

TECHNICAL FIELD OF DISCLOSURE

The present disclosure relates to a body training tool. Specifically, the present disclosure relates to an apparatus for aiding in the training of upper extremities.

INTRODUCTION

Strength training has been found to provide a variety of benefits to those seeking health improvements, including but not limited to an improvement in cardiovascular health, bone health, and increased energy levels. Proper strength training may further decrease risk of injury when engaging in other forms of physical activity. However, use of training equipment which is not specifically sized or fitted for the individual may increase the risk of injury when using such equipment. Moreover, many handheld soft-weighted training apparatus deform with use, causing the user to lose grip.

Therefore, it would be desirable to provide a device providing an adjustable grip. Further, it would be desirable to provide a device which may be adjusted to tighten a user's grip on the device as the device undergoes prolonged use.

Additionally, active individuals and gymgoers have a variety of hand sizes. Thus, is would be desirable to provide a device configured for utilization by the broad range of users.

SUMMARY

This Summary is provided to introduce a selection of concepts in a simplified form that are further described below in the Detailed Description. This Summary is not intended to identify key features or essential features, nor is it intended to limit the scope of the claims included herewith.

An aspect of the present disclosure may include a training device including

BRIEF DESCRIPTION OF THE DRAWINGS

Objects, aspects, features, and advantages of embodiments disclosed herein will become more fully apparent from the following detailed description, the appended claims, and the accompanying drawing figures in which like reference numerals identify similar or identical elements. Reference numerals that are introduced in the specification in association with a drawing figure may be repeated in one or more subsequent figures without additional description in the specification in order to provide context for other features, and not every element may be labeled in every figure. The drawing figures are not necessarily to scale, emphasis instead being placed upon illustrating embodiments, principles and concepts. The drawings are not intended to limit the scope of the claims included herewith

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

Figure 1:
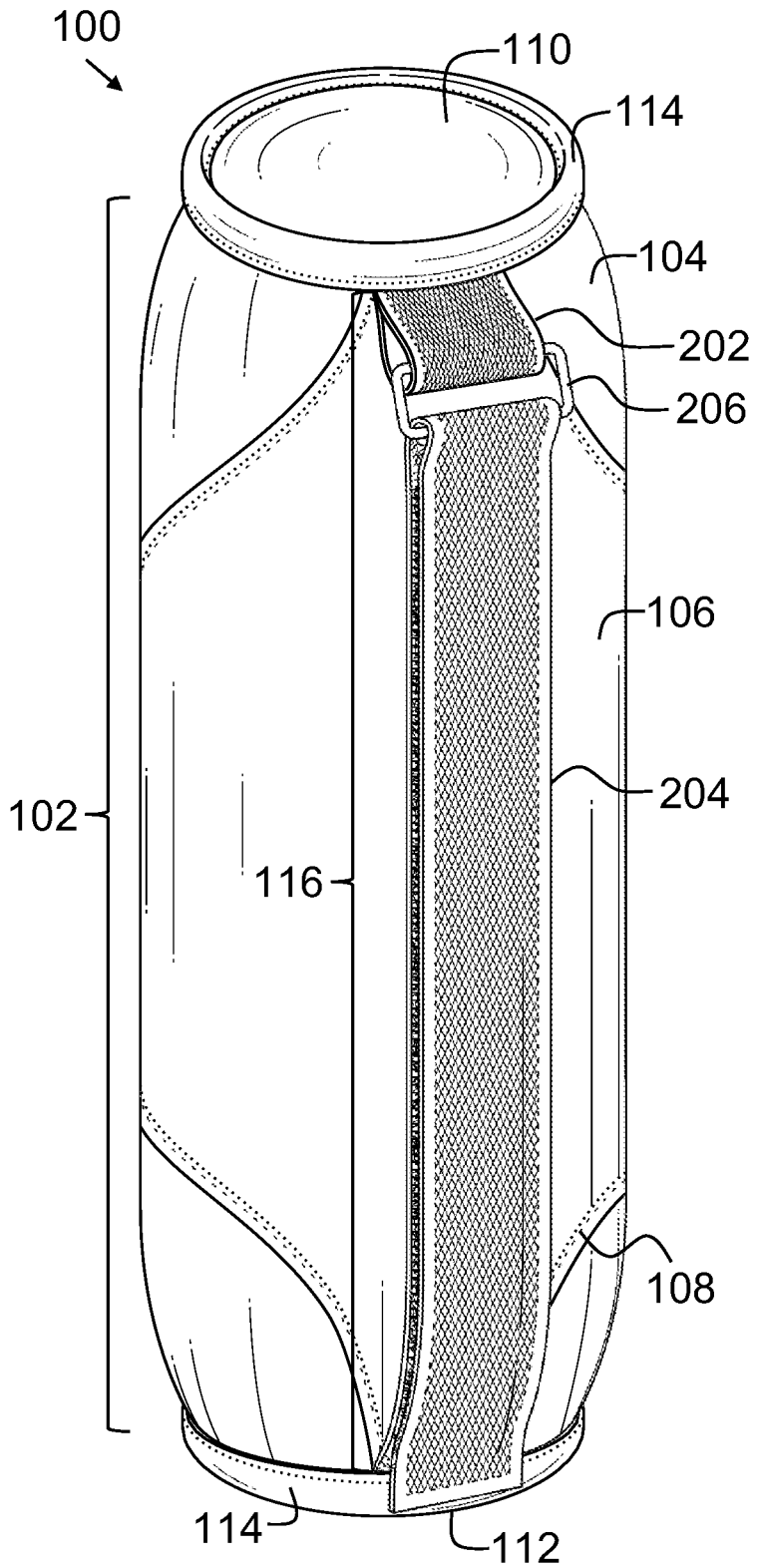
FIG. 1 shows a front-right perspective view of a training apparatus according to aspects of the present disclosure.
Figure 2:
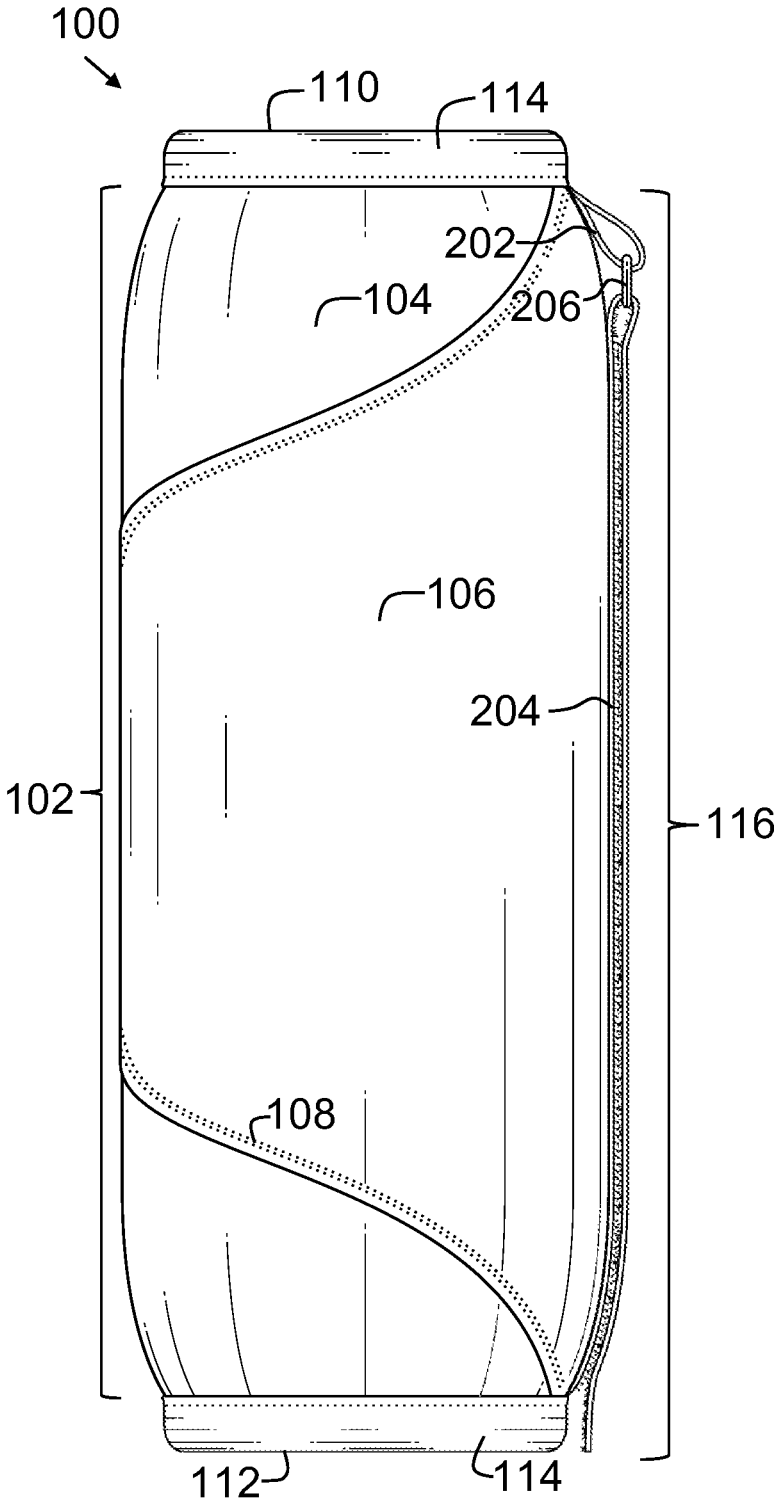
FIG. 2 shows a side view of a training apparatus according to aspects of the present disclosure.
Figure 3:
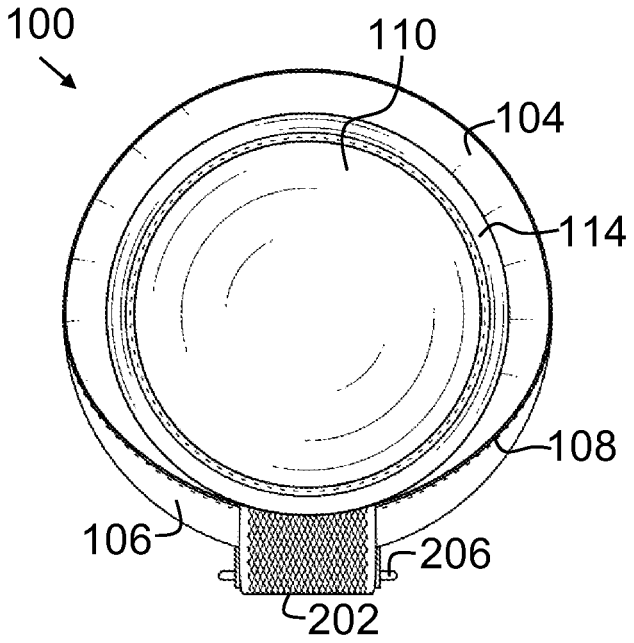
FIG. 3 shows a top view of a training apparatus according to aspects of the present disclosure.
Figure 4:
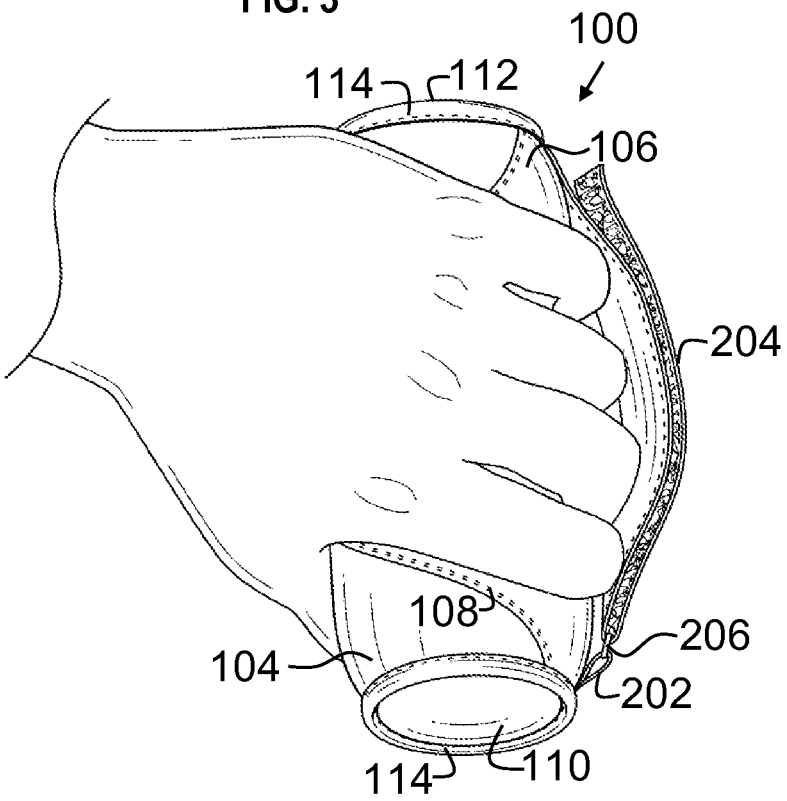
FIG. 4 shows a training apparatus in use according to aspects of the present disclosure.

FIG. 1 shows a front-right perspective view of a training device 100 for training the upper extremities. In an embodiment, and as exemplified in FIGS. 1-4, the training device 100 may comprise a cylindrical shape. However, the training device 100 may comprise other suitable shapes such as cuboid or triangular prism. The training device 100 may comprise an outer layer 102. The outer layer 102 may be constructed from a flexible material including neoprene, elastane, triexta, nylon, polyester, cotton, silk, wool, or combinations thereof. The material of the outer layer 102 may be configured to contain the contents of the training device 100, which is discussed in greater detail below. Further, the outer layer 102 may be waterproof, or otherwise "sweat-proof," as to prolong the structural integrity of the training device 100 over the duration of use. In one embodiment, the outer layer 102 include a coating or film disposed on its surface, wherein the coating or film is hydrophobic. In yet another embodiment, the outer layer 102 may include a textured coating and/or may otherwise be composed of a texture material, such that a gripping friction may exist between the outer layer 102 and a user's hand.

The outer layer 102 may include a first section 104 and a second section 106. The first and second sections 104/106 may be constructed from the same, or different materials. In an embodiment, both the first and second sections 104/106 are constructed using neoprene. Alternatively, the outer layer 102 may include a singular continuous sheet of material.

The first and second sections 104/106 may be joined along a partial perimeter of each respective section 104/106. The partial perimeters of the first and second sections 104/106 may join via a stitching 108. The stitching 108 may be configured to withstand the grip of a user without splitting and spilling the contents of the training device 100. Such stitching 108 may include an overlock stich, zig-zag stitch, turn & stitch, or bound edges. However, any suitable stitch or seam may be used. An adhesive may be solely utilized or may be used in conjunction with the stitching methods described above.

Each of the first and second sections 104/106 may comprise a different shape or color. In an embodiment, the first and second sections 104/106 are configured to interface with each other so as to allow for a snug fit between their joined partial perimeters. The first and second sections 104/106 may join along a flat perimeter. In a further embodiment, and as exemplified in FIG. 1, the first and second sections 104/106 may join along a shaped perimeter. The first and second sections 104/106 may include different colors based on the user's preference. It is further contemplated that designs may be printed onto the first and second sections 104/106 to make the design of the training device 100 more visually appealing.

In an alternate embodiment, the second section 106 may be disposed over the first section 104. For example, the first section 104 may be a continuous sheet forming the entire sidewall surface of the training device 100 and the second section 106 may be disposed atop the first section 104 over a desired surface area. In such a non-limiting example, the outer perimeter of the second section 106 may be sewn or otherwise affixed to the first section 104. In yet another alternate embodiment, the first section 104 may be disposed over the second section 106. For example, the second section 106 may be a continuous sheet forming the entire sidewall surface of the training device 100 and the first section 104 may be disposed atop the second section 106 over a desired surface area. In such a non-limiting example, the outer perimeter of the first section 104 may be sewn or otherwise affixed to the second section 106. Layering the first section 104 over the second section 106 or the second section 106 over the first section 104 may create a more rigid and structurally sound training device 100. Further, such an arrangement may more securely contain the contents of the training device 100.

As discussed above, the outer layer 102 may be configured to contain the contents of the training device 100. The contents may include a plurality of micro-beads which may include sand or other suitable materials such as microfiber beads, glass, steel beads, pebbles, or grains. In an embodiment, a liquid (e.g., water) may be used to fill the training device 100 to achieve a desired weight. In such an embodiment, the training device may further include one or more valves. The valves may allow a user to fill or drain the training device 100 until a desired weight is achieved. The contents may include a variety of other materials and is not limited to any particular material. Different combinations or quantities of materials may be used to achieve a desired weight of the training device 100. To maintain a desired shape of the training device 100, a combination of beads and solid shaped weights may be used. As a non-limiting example, the contents may include a cylindrical weight surrounded by beads. In such an embodiment, the cylindrical weight provides a substantial amount of the desired weight of the training device 100, while the beads fill out the remaining space within the training device 100. While the solid shaped weight in the previous example comprised a cylinder, any suitable shape may be used. Moreover, any suitable material may be used depending on the desired density of the solid shaped weight. For example, the solid shaped weight may be constructed from any one of iron, steel, aluminum, concrete, or brass.

In an embodiment, the contents inside the training device 100 are held within a flexible container to prevent leakage in the event that the outer layer 102 is compromised. The flexible container may be constructed from polyethylene. However, any suitable material may be used. The flexible container may be joined at certain points to an interior surface of the outer layer 102. By doing so, the flexible container may be preventing from shifting around inside the training device 100 when in use. The flexible container may be divided into one or more pockets to prevent unwanted shifting of the contents when the training device 100 is in use.

The training device 100 may include a first end 110 and a second end 112 located at opposing ends of the training device 100. Each end 110/112 may comprise material which is separate from the outer layer 102, and may be attached to their respective cuffs 114. In an embodiment, each end 110/112 comprises the same material as the outer layer 102.

Each end 110/112 may include one or more cuffs 114. The cuffs 114 may have a circumference which is less than the circumference of the body or approximate mid-point of the training device 100. This may enable tension to be created across the outer layer 102 between the first end 110 and second end 112. By creating tension across the outer layer 102, the training device 100 may be able to hold a consistent form and prevent unwanted sagging of the outer layer 102. In an embodiment, the cuff 114 is attached to its respective end 110/112, the first portion 104, the second portion 106, and/or the first piece 202 or second piece 204 of the adjustable handle 116. The stitching used to attach the cuff 114 may be the same as any one of the stitching methods used to attach the first piece 102 and second piece 104. However, any suitable stitching method may be used. To maintain the structure of the training device 100, the cuffs 114 may contain an insert. The insert may be constructed from a rigid material including metal, wood, or polyethylene. However, flexible materials such as silicone may be used depending on the desired properties of the cuffs 114.

The training apparatus 100 may include an adjustable handle 116. The adjustable handle 116 may include a first piece 202 and a second piece 204. To allow for air circulation, the adjustable handle 102 may include a nylon mesh as well as other materials including neoprene, elastane, triexta, nylon, polyester, cotton, silk, wool, or combinations thereof. Either elastic or non-elastic materials may be used to construct the adjustable handle 116 depending on the desired adjustability properties of the adjustable handle 116. However, any suitable mesh material may be used. The first piece 202 may include a fastener loop 206. The fastener loop 206 may be configured to receive the second piece 204 of the adjustable handle 116. In an embodiment, the fastener loop 206 is constructed from steel. However, any suitable material may be used such as iron, aluminum, or stainless-steel.

In an embodiment, the adjustable handle 116 features one or more finger loops. The one or more finger loops may be disposed onto a surface of the second piece 204 or the outer layer 102. Each loop of the one or more finger loops may be configured to accept a user's finger. As a non-limiting example, there may be four finger loops disposed on the outer layer 102 such that, when held by the user, one of the four user's fingers passes through each of the finger loops. Such a configuration may assist in preventing the training device 100 from slipping out of the user's hand. Each finger loop may be constructed using an elastic material such as isoprene, neoprene, or any other suitable material. In such an embodiment, the circumference of an opening defined by the finger loop may be slightly less than the circumference of an average user's finger, such that a snug fit is achieved when the training device 100 is in use.

The second piece 204 may include means for fastening along its length. The fastening means may include hook and loop. In such an embodiment, approximately half of the length of the second piece 204 may include the hook portion, while the other approximate half of the length may include the loop portion. It is also contemplated that other fastening means may be utilized such as buttons, snaps/poppers, magnets, or other suitable fastening means. The length of the second piece 204 may be sufficiently sized so as to allow the second piece 204 to pass through the fastener loop 206 and reflect back on itself to allow for fastening. To ensure a comfortable fit, the first piece 202 may have a length which is less than the length of the second piece 204. This may allow for the fastener loop to sit to the side of the user's hand when in use.

The first and second pieces 202/204 may be attached to their respective cuffs 114. For example, the portion of the first piece 202 may extend into the interior of its respective cuff 114 and be secured by the cuffs 114 stitching. Likewise, a portion of the second piece 204 may extend into the interior of its respective cuff 114 and be secured by the cuffs 114 stitching. Alternatively, the first and/or second piece 202/204 may be attached to the outer layer 102 and not extend into the interior of their respective cuffs 114.

Various elements, which are described herein in the context of one or more embodiments, may be provided separately or in any suitable sub-combination. Further, the processes described herein are not limited to the specific embodiments described. For example, the processes described herein are not limited to the specific processing order described herein and, rather, process blocks may be re-ordered, combined, removed, or performed in parallel or in serial, as necessary, to achieve the results set forth herein.

It will be further understood that various changes in the details, materials, and arrangements of the parts that have been described and illustrated herein may be made by those skilled in the art without departing from the scope of the following claims.

All references, patents and patent applications and publications that are cited or referred to in this application are incorporated in their entirety herein by reference. Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A training device comprising:

an outer layer;

a first end and a second end located at opposing ends of the training device, wherein each end includes a cuff;

an adjustable handle including a first piece, a second piece, and a fastener loop, wherein the fastener loop is configured to accept the first piece and the second piece; and a contents disposed within a void defined by the outer layer and first and second ends.

2. The training device of claim 1, wherein the outer layer comprises a first section, and a second section.

3. The training device of claim 1, wherein the adjustable handle includes nylon mesh.

4. The training device of claim 1, wherein the circumference of each cuff is less than the circumference of an approximate mid-point of the training device.

5. The training device of claim 1, wherein the adjustable handle includes one or more finger loops configured to accept a user's finger(s).

6. The training device of claim 5, wherein the one or more finger loops include an elastic material.

7. The training device of claim 1, wherein the contents include sand.

8. The training device of claim 1, wherein the contents include a cylindrically shaped iron weight.

9. The training device of claim 1, wherein the contents are further contained within a flexible container.

10. The training device of claim 1, wherein the adjustable handle fastens via hook and loop.

11. The training device of claim 1, wherein each cuff includes an insert disposed within an interior defined by each cuff.

12. The training device of claim 11, wherein the insert is rigid.

13. The training device of claim 11, wherein the insert is flexible.

14. The training device of claim 1, wherein the adjustable handle includes one or more magnets, and wherein the adjustable handle is configured to fasten via the one or more magnets.

* * * * *